US006709233B2

(12) United States Patent
Haller

(10) Patent No.: US 6,709,233 B2
(45) Date of Patent: Mar. 23, 2004

(54) AEROFOIL FOR AN AXIAL FLOW TURBOMACHINE

(75) Inventor: Brian Robert Haller, Market Resan (GB)

(73) Assignee: Alstom Power N.V., Amsterdam (NL)

( * ) Notice: Subject to any disclaimer, the term of this patent is extended or adjusted under 35 U.S.C. 154(b) by 237 days.

(21) Appl. No.: 09/958,821

(22) PCT Filed: Feb. 19, 2001

(86) PCT No.: PCT/GB01/00682

§ 371 (c)(1),
(2), (4) Date: Jan. 11, 2002

(87) PCT Pub. No.: WO01/61152

PCT Pub. Date: Aug. 23, 2001

(65) Prior Publication Data

US 2002/0197156 A1 Dec. 26, 2002

(30) Foreign Application Priority Data

Feb. 17, 2000 (GB) ..... 0003676

(51) Int. Cl.[7] ..... F01D 5/14; F01D 9/04

(52) U.S. Cl. ..... 415/192; 415/208.2; 416/223 A; 416/238; 416/242; 416/243; 416/DIG. 2; 416/DIG. 5

(58) Field of Search ..... 415/183, 191, 415/192, 208.1, 208.2, 211.2; 416/223 R, 223 A, 238, 243, 242, DIG. 2, DIG. 5

(56) References Cited

U.S. PATENT DOCUMENTS

| | | | | | |
|---|---|---|---|---|---|
| 4,585,395 A | * | 4/1986 | Nourse et al. | ..... | 416/223 A |
| 4,682,935 A | * | 7/1987 | Martin | ..... | 416/223 A |
| 4,741,667 A | * | 5/1988 | Price et al. | ..... | 415/191 |
| 5,286,169 A | | 2/1994 | Dinh et al. | | |
| 5,326,221 A | * | 7/1994 | Amyot et al. | ..... | 415/191 |
| 5,352,092 A | * | 10/1994 | Ferleger et al. | ..... | 416/223 A |
| 5,480,285 A | | 1/1996 | Patel et al. | | |
| 5,525,038 A | | 6/1996 | Sharma et al. | | |
| 5,779,443 A | * | 7/1998 | Haller et al. | ..... | 415/191 |
| 6,022,188 A | | 2/2000 | Bancalari | | |

FOREIGN PATENT DOCUMENTS

| | | | | | |
|---|---|---|---|---|---|
| CH | 335694 | | 3/1959 | | |
| CH | 586841 | | 6/1973 | | |
| DE | 2 144 600 | | 3/1973 | | |
| EP | 0 704 602 A2 | | 4/1996 | | |
| GB | 323941 | | 1/1930 | | |
| GB | 768026 A | * | 2/1957 | ..... | 416/223 A |
| GB | 2151310 A | * | 7/1985 | ..... | 416/223 A |
| GB | 2295860 A | * | 12/1996 | ..... | 415/192 |

* cited by examiner

*Primary Examiner*—Christopher Verdier
(74) *Attorney, Agent, or Firm*—Kirschstein, et al.

(57) ABSTRACT

A turbine stator vane for use in an axial flow gas turbine. The vane has an aerofoil, the pressure face of which is convex between platform and tip regions in a plane which extends both radially of the turbine and transversely of the general working fluid flow direction between the vanes. The trailing edge of the aerofoil is straight from platform to tip, and the spanwise convex and concave curvatures of the aerofoil pressure and suction surfaces respectively are achieved by rotational displacement of the aerofoil sections about the straight trailing edge. However, the axial width of the aerofoil is substantially constant over substantially all of the aerofoil radial height and the chord line at mid-height aerofoil sections is shorter than the chord lines in aerofoil sections at platform or tip regions. Reducing chord length at the mid-height region in this way lowers aerodynamic profile losses without unduly affecting vane performance. Also disclosed is a turbine rotor blade designed to form a stage pair with the stator vane.

20 Claims, 5 Drawing Sheets

AEROFOIL FOR AN AXIAL FLOW TURBOMACHINE

TECHNICAL FIELD OF THE INVENTION

The invention relates to improved aerofoil shapes for use as stator vanes or rotor blades in turbines of axial flow turbomachines, such as gas turbine engines.

BACKGROUND

Turbomachines are used to add energy to a working fluid and/or to extract energy from it. Accordingly, they may comprise compressors and/of turbines. For example, gas turbine engines typically comprise three main sections; a compressor section, a combustion section and a turbine section. Air from the atmosphere is drawn into and is compressed by the compressor. It is then passed into the combustion section where fuel is added and the mixture ignited so that an energised working fluid is created in the form of a pressurised hot gas. The working fluid passes from the combustion section to the turbine section where its energy is extracted by turbine blades and used to turn the compressor via a turbine shaft and do additional work. Eventually the working gas, now at much reduced temperature and pressure, is discharged to atmosphere via an exhaust duct system.

In the present invention, the means used to convert turbine working fluid energy into shaft rotational energy is a system of aerofoils comprising axial flow rotor blades and stator vanes. The rotor blades and stator vanes are arranged to intercept the working fluid as a number of axially successive annular rows. Each rotor blade is attached to a turbine rotor disc or drum via a blade root portion, the disc or drum being mounted on a rotor shaft, the longitudinal centre line of which defines the rotational axis of the turbine. The stator vanes are fixed, e.g., to a circumscribing turbine casing or to an inner static drum, and rows of vanes and blades alternate with each other so that each row of blades is paired with a preceding row of stator vanes. Each such pair of rows is collectively termed a stage and a turbine will comprise at least one stage.

Whereas the function of the rotor blade rows is to extract energy from the working fluid and transfer it to a turbine rotor disc or drum and hence to the shaft, the function of the stator vanes is to smooth the flow of the working fluid and then direct it at an optimum outlet angle to the rotor blades so that efficient energy transfer may be achieved there to turn the rotor. The efficiency with which both blades and vanes perform their function is of vital importance in determining stage efficiency.

In the gas turbine engine field, aerofoils of turbine vanes and blades have respective generic types of cross-section profile and may bear a strong visual likeness one to another, notwithstanding scale differences usually dependent upon engine size. However, on inspection it is found there are measurable differences of aerofoil profiles not only between engines of different make and type but also between turbine stages of the same engine. Further, such differences way have significant effects on turbine efficiency. Similarly, there are differences in other aspects of turbine stage design which alone or in combination also have an effect. Small differences in such design features, which may appear minimal or unimportant to those unskilled in the art, may in fact have a significant effect on turbine stage performance.

Hence, vane and blade geometrical shapes, their positional relationships to each other and also to the stream of working fluid have an effect on turbine efficiency and thus on turbomachine efficiency overall. In known state-of-the art gas turbine engines, the turbine stage efficiency is currently in the region of 90% and at such high efficiency it is regarded as now very difficult to improve by even parts of 1%. Nonetheless, it is an object of the present invention to increase turbine stage efficiency by a significant amount.

In part, the present invention incorporates and improves upon previous teachings in respect of so called "Controlled Flow" principles by the present inventor and others. In particular, see patent GB 2 295 860 B "Turbine Blade", directed particularly at steam turbines. Other patents showing similar principles include U.S. Pat. No. 5,326,221 Amyot et al. (for steam turbines) and U.S. Pat. No. 4,741,667 Price et al. (for gas turbines).

Definitions

For the purposes of the present invention, it will be understood that the term "vane" refers to the stator blades which precede the rotor blades in turbomachines, including the so-called "nozzle guide vanes" in gas turbine engines, which function to direct the hot gases from the combustor onto the first stage of turbine rotor blades. Also, when the word "blade" is used without the qualifying words "stator" or "rotor", it should be taken to mean "rotor blade"

The radially innermost extremity of the aerofoil portions of axial flow blades and vanes will be termed their "platform region" (even though the radially innermost portion of a gas turbine rotor blade is usually termed a "root"), and the radially outermost extremities of their aerofoil portions will be termed their "tip region" (despite the fact that blades and vanes can have radially outer shrouds).

The "pressure" surface of an aerofoil section shape is its concave side and the "suction" surface is its convex side.

A "prismatic" aerofoil is designed such that the notional aerofoil sections of the blade or vane, each considered orthogonal to a radial line from the turbine axis, have the same shape from the aerofoil platform region to the aerofoil tip region, are not skewed, i.e., have the same setting angle from the platform region to the tip region, and are "stacked" one on top of another so that their leading edges and their trailing edges collectively form straight lines in the radial direction.

The outlet angle $\alpha$ of an aerofoil is the angle, relative to the circumferential direction of the rotor, that the working fluid leaves a vane or blade row and is derived from the relationship:

$$\alpha=\sin^{-1}(T/P),$$

where T is the throat dimension and P is the pitch dimension.

Throat dimension T is defined as the shortest line extending from one aerofoil trailing edge normal to the suction surface of the adjacent aerofoil in the same row, whereas pitch dimension P is the circumferential distance from one aerofoil trailing edge to the adjacent aerofoil trailing edge in the same row at a specified radial distance from the platform region of the aerofoil.

The setting angle $\beta$ is the angle through which any particular aerofoil section at a station along the height or span of the aerofoil is displaced in its own plane from a predetermined zero datum. The datum may, for example, be taken as being where the aerofoil section has the same "stagger angle", i.e. the same orientation relative to the turbine axis, as a known prismatic aerofoil in a known turbine utilising such aerofoils.

The "chord line" is the shortest line tangent to leading and trailing edge radii of an aerofoil section. The "chord length" is the distance between two lines normal to the chord line and passing through the points where the chord line touches the leading and trailing edges respectively.

The "axial widths" of an aerofoil is the axial distance between its leading and trailing edges, i.e., the distance between its leading and trailing edges as measured along the rotational axis of the turbine.

SUMMARY OF THE INVENTION

According to a first aspect of the present invention, a turbine stator vane is for use in a ring of similar vanes arranged in an axial flow turbine having an annular path for a turbine working fluid, the vane comprising an aerofoil spanning the annular path and having a radially inner platform region, a radially outer tip region, an axially forward leading edge and an axially rearward trailing edge, the aerofoil having a pressure surface and a suction surface which are respectively convex and concave between the platform region and the tip region in a plane extending both radially of the annular path and transversely of the axial direction, the trailing edge of the aerofoil being straight from the platform region to the tip region and oriented radially of the annular path, and said convex and concave curvatures of the aerofoil pressure and suction surfaces being achieved by rotational displacement of the aerofoil sections about the straight trailing edge, the axial width of the aerofoil being substantially constant over substantially all of the aerofoil radial height and the chord line at mid-height aerofoil sections being shorter than the chord lines in aerofoil sections at platform or tip regions.

In the context of a gas turbine engine, the invention in its first aspect may be applied to the aerofoils of nozzle guide vanes in the first or high pressure stage of the turbine, but also to the stator vanes of succeeding stages. Because the chord line at mid-height aerofoil sections is shorter than the chord lines in aerofoil sections at both the platform regions and the tip regions, the aerofoil exhibits a so-called "compound lean" appearance when viewed on its leading edge, in which the aerofoil is skewed in the same circumferential direction at both radial extremities.

In accordance with a second aspect of the invention, if the aerofoil is that of a nozzle guide vane at the entry to a gas turbine, the aerofoil is preferably positioned in relation to the axial length of the turbine such that the trailing edge of the aerofoil is in a divergent part of the gas flow passage, whereby the trailing edge of the aerofoil is substantially longer than its leading edge.

In the case of a nozzle guide vane aerofoil, the aerofoil's platform and tip outlet angles are preferably of substantially the same value, for example, not more than about 10 degrees, preferably in the range 8–10 degrees. The aerofoil's outlet angle at mid-height of the aerofoil may be in the range 13–16 degrees, preferably approximately 14 degrees.

Conveniently, the aerofoil is of approximately constant aerofoil cross-section from its platform region to its tip region.

In accordance with a further aspect of the invention, a turbine stage comprises a row of stator vanes as described above, and a row of rotor blades in flow sequence with the vanes, in which the blades comprise aerofoils having a radially inner platform region, a radially outer tip region, an axially forward leading edge and an axially rearward trailing edge, each blade aerofoil having a pressure surface and a suction surface which are respectively convex and concave between the platform region and the tip region in a plane extending both radially of the annular path and transversely of the axial direction, said convex and concave curvatures of the aerofoil pressure and suction surfaces being achieved by rotational displacement of the aerofoil sections about a radial line through the aerofoil, each aerofoil having outlet angles which are smaller near its platform and tip regions than at mid-height.

From an aerodynamic point of view, each blade aerofoil ideally has a radially oriented straight trailing edge, the rotational displacement of the aerofoil sections being about the straight trailing edge, though this ideal may be compromised by the dynamic design requirements of the blades.

To reduce dynamic loading at the root fixings and the platform, the blade aerofoil may taper from its platform region to its tip region, such that its chord length reduces over the blade aerofoil's radial height from a maximum at its platform region to a minimum at its tip region and its leading edge has a backward lean in the axial direction.

In yet another aspect, the invention provides a turbine stage comprising a row of nozzle guide vanes having aerofoils as described above, and a row of rotor blades in flow sequence with the vanes, in which the blade aerofoil platform and tip outlet angles are in the range 14–17 degrees, preferably about 16 degrees. The blade aerofoil outlet angle at mid-height of the aerofoil may be in the range 18–21 degrees, preferably about 19 degrees The invention is believed applicable whether the aerofoils are shrouded or unshrouded, i.e., whether the aerofoils are joined to a structure forming an outer wall of the passages between adjacent aerofoils, or are not so joined, but are free at their radially outer or tip regions.

Further aspects of the invention will be apparent from the following description and claims.

BRIEF DESCRIPTION OF THE DRAWINGS

Exemplary embodiments of the invention will now be described with reference to the accompanying drawings, in which.

DETAILED DESCRIPTION OF PREFERRED EMBODIMENTS

Figure 1:
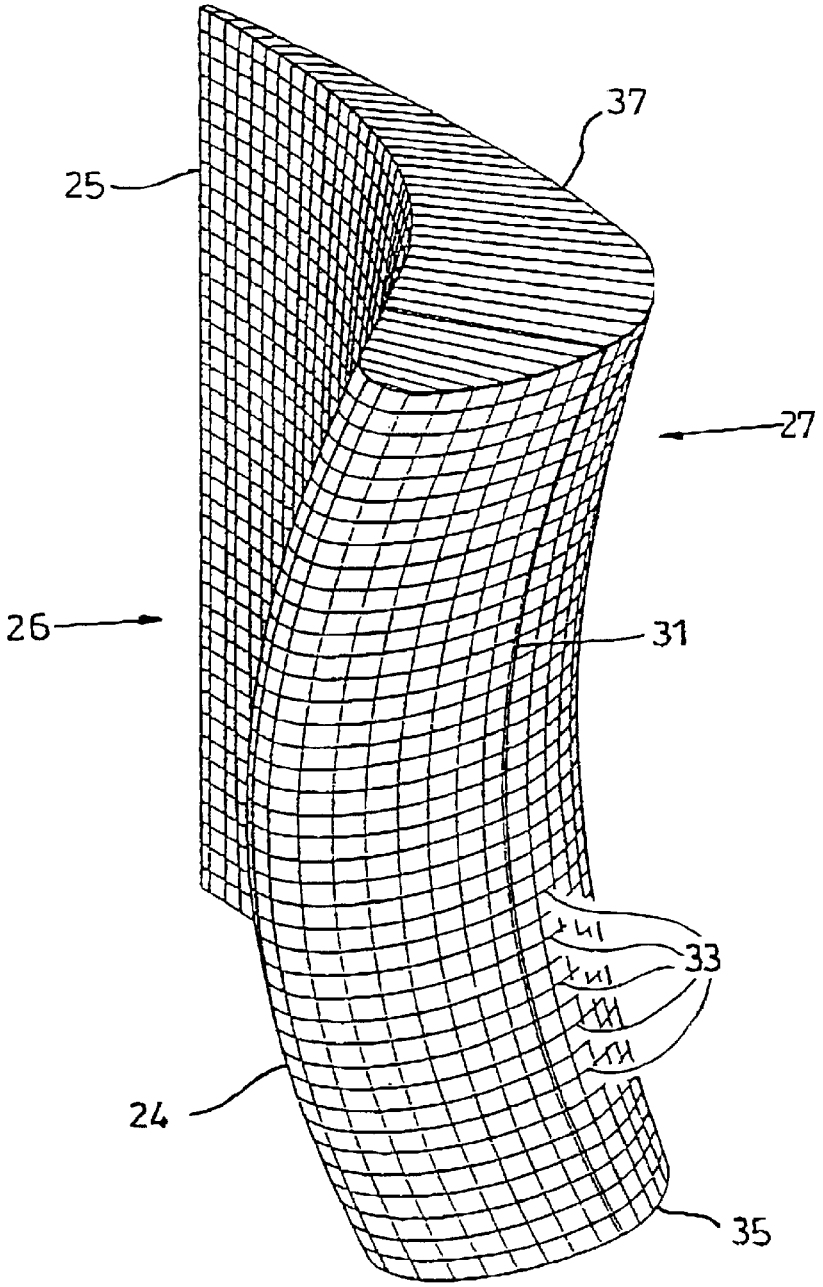
Fig. 1 (PRIOR ART)
FIG. 1 is a computer generated perspective view of a prior art aerofoil shape utilising the "Controlled Flow" principle.

FIG. 1, extracted from Patent Number GB 2 295 860 B, to which the reader is referred for further details, shows the aerofoil of a steam turbine stator blade or vane which is shaped in accordance with the principles of the invention disclosed in that patent. The grid pattern shown on the surface is computer-generated and serves to emphasize the curved formation of the aerofoil. It has a straight trailing edge 25 like previously known aerofoils, but the remainder of the aerofoil, and in particular the leading edge 24, is not straight but is curved in a manner such that the pressure surface 26 of the aerofoil is convex between platform region 35 and tip region 37 in a plane which extends both radially of the turbine and transversely of the general steam flow direction between the aerofoils. One such plane 31 is indicated, the convex curvature in this plane on the pressure surface 26 being obscured but conforming to that at the leading edge 24.

More specifically, relative to a prismatic aerofoil, the individual aerofoil sections 33 may be considered as being rotated in their own planes about the trailing edge 25 by a setting angle which is positive in the central part of the radial height, and negative in the platform and tip portions. 'Positive' is taken to be a rotation toward the pressure surface 26 and 'negative' is taken to be a rotation toward the suction surface 27.

In FIG. 1, the setting angle varies in parabolic manner from about minus 2.50° at the platform and tip regions to plus 2.5° at the centre of the radial height, referred to a datum stagger angle of 48.5°.

It would to some extent be acceptable to skew the aerofoil sections about some other axis than the trailing edge 25, for example a radial line through the leading edge 24 or some intermediate axis. However, the choice of the trailing edge as the axis about which the aerofoil sections are rotated has several advantages. It keeps the critical interspace gap between the fixed vanes and the downstream rotor blades constant. This gap has an important influence upon the unsteady aerodynamic forces on the moving blade and also on the stage efficiency via boundary layer growth on the radially inner and outer turbine passage walls (termed the "end walls"). Secondly, by building the curvature largely into the leading edge a "Compound Lean" effect is incorporated into the leading edge area of the aerofoil where secondary flows are generated. These secondary flows comprise vortices in parallel with the main flow, the vortices being near the end walls between adjacent fixed blades. By the use of the compound curved aerofoil of FIG. 1, over the inner (i.e. lower) half of the aerofoil height the pressure surface points radially inwards, and over the outer half of the aerofoil height the pressure surface points radially outwards. The body forces exerted on the flow are counteracted by higher static pressures on the end walls. This results in lower velocities near the end walls and hence lower frictional losses.

Figure 2:
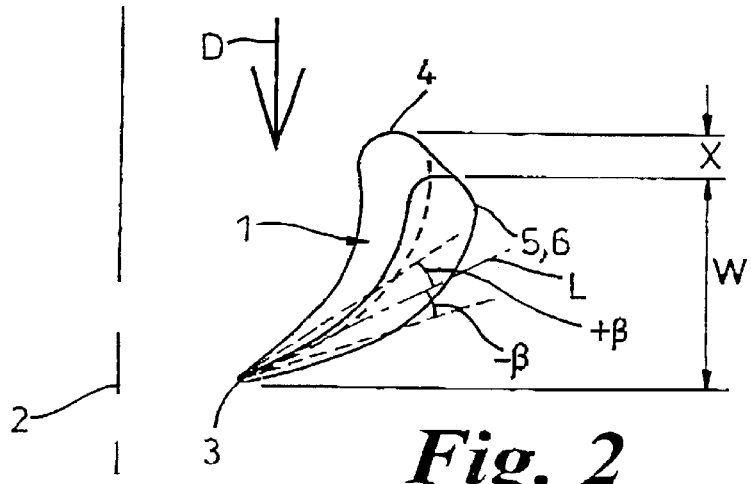
Fig. 2 (PRIOR ART)
FIG. 2 is a sketch of a prior art gas turbine vane aerofoil as viewed from the tip end of the aerofoil towards the platform end.
Figure 3:
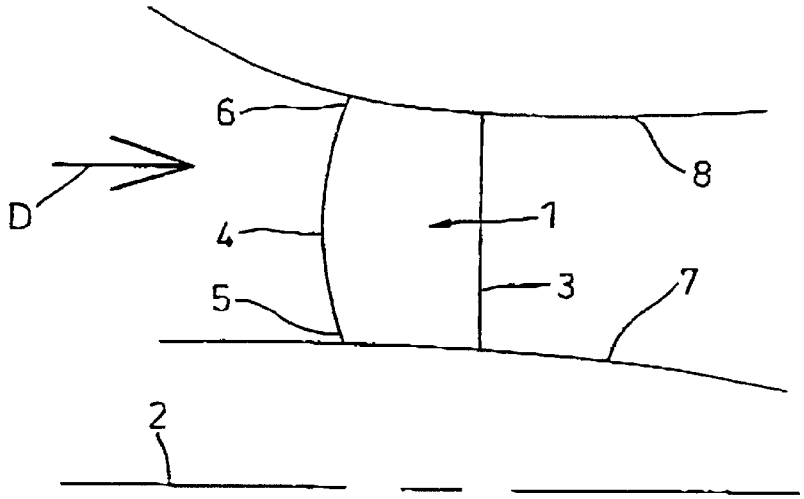
Fig. 3 (PRIOR ART)
FIG. 3 is an axial side view of the vane aerofoil of FIG. 2 showing its position in the turbine passage.

FIGS. 2 and 3 show a prior art gas turbine vane whose aerofoil 1 is designed on similar principles to that of FIG. 1. Dashed line 2 represents the axial centre line of the turbine, 7 and 8 are radially inner and outer walls defining the turbine working fluid passage, 4 is the leading edge at vane mid-height region, 5 and 6 are platform and tip regions respectively, the arrow D indicates the overall direction of flow of the working fluid and the angle which line L makes with the axis 2 represents the prismatic aerofoil datum stagger angle. As in FIG. 1, the vane aerofoil sections arm stacked about a straight, radially oriented trailing edge 3 and are rotated or "skewed" toward the closed position at leading edge platform and tip, i.e. at leading edge platform and tip the setting angle is at its greatest negative value $-\beta$ relative to the datum line L and the throat dimension T (see FIG. 7) is at a minimum. For clarity, FIG. 2 shows an exaggerated platform and tip skew. However, at the mid-height of the aerofoil, the setting angle is at its greatest positive value $+\beta$. Thus, the leading edge at vane mid-height region, 4, is axially forward of the leadings edge at platform and tip regions, 5 and 6, by an amount "X". This means that even though the chord lines of all the aerofoil sections are the same length, the axial width W of the aerofoil (i.e., the distance between its leading and trailing edges 4, 3 in the axial direction) varies by X over the radial height of the aerofoil.

Figure 4:
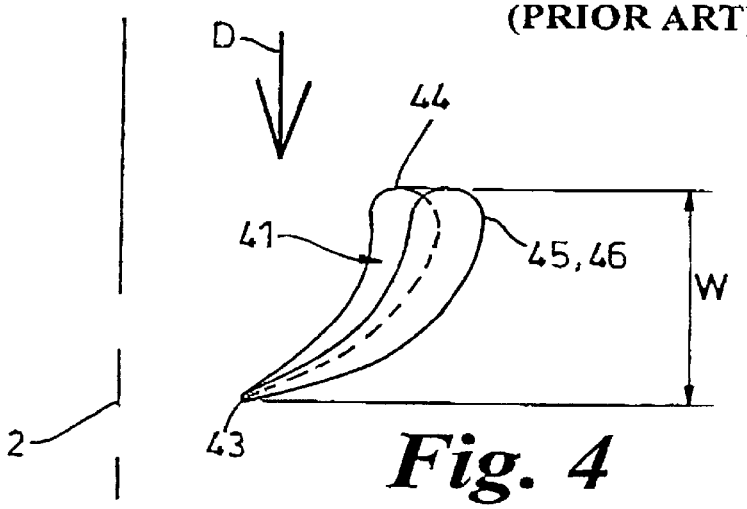
FIG. 4 is a view similar to FIG. 2, but of a vane aerofoil shaped according to the present invention.
Figure 5:
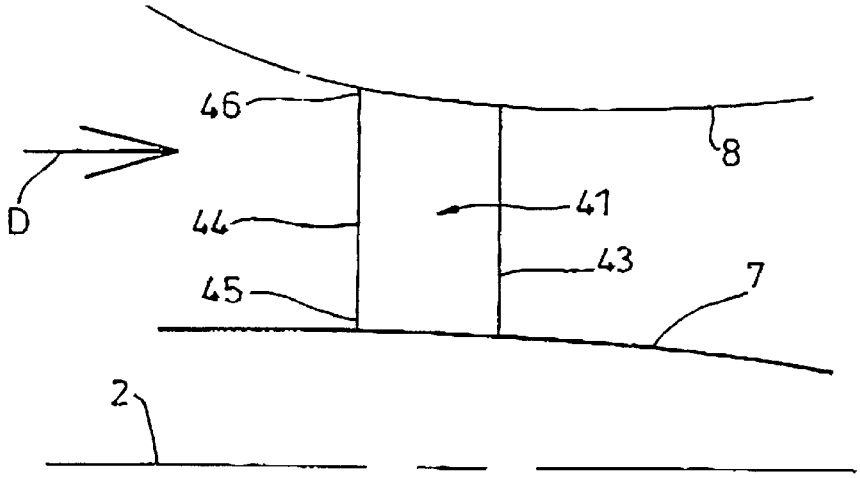
FIG. 5 is an axial side view of the vane aerofail of FIG. 4.
Figure 8:
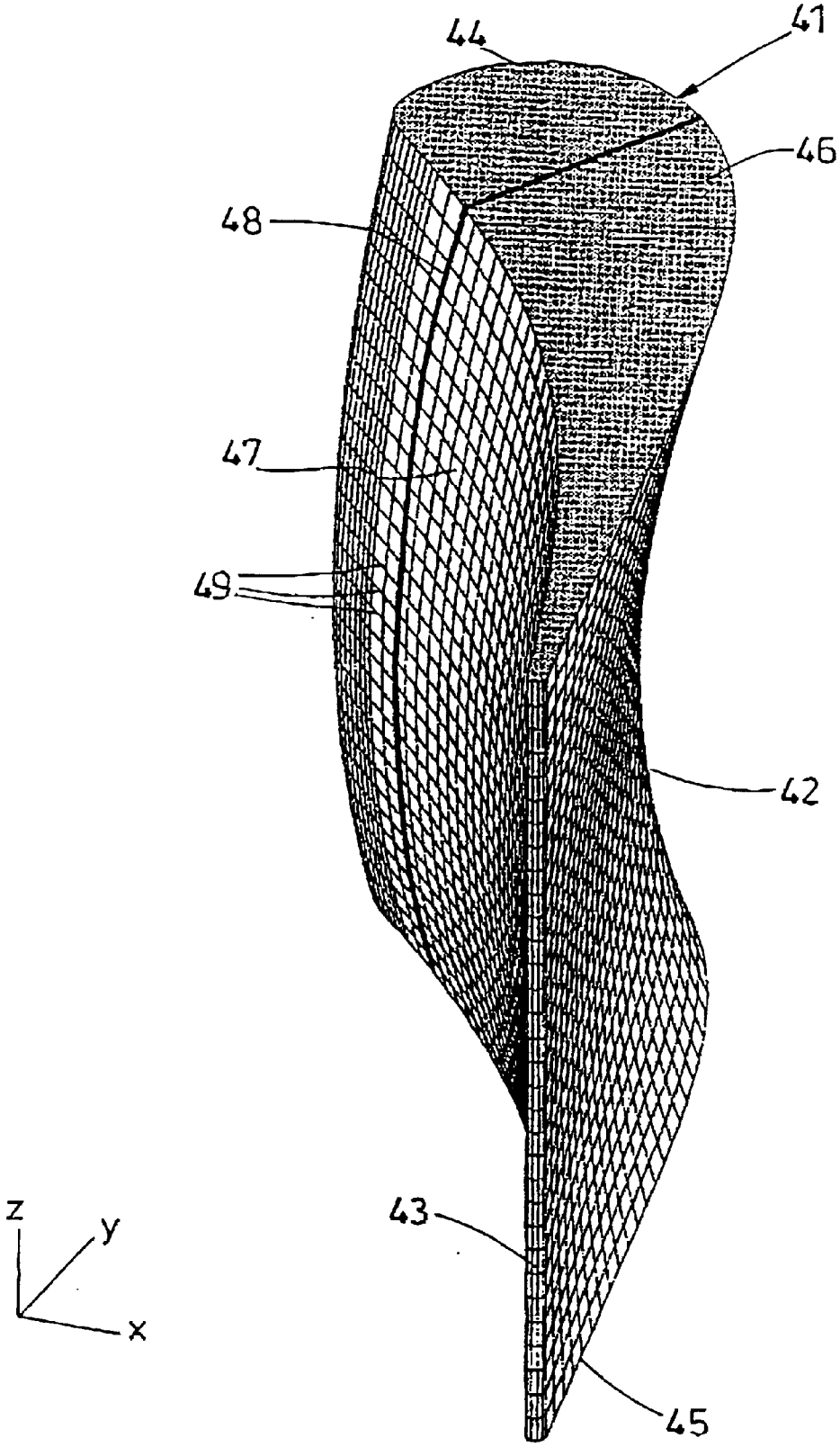
FIG. 8 is a computer generated perspective view of an aerofoil of a gas turbine engine nozzle guide vane shaped in accordance with the present invention.

Referring now to FIGS. 4, 5 and 8, the views in FIGS. 4 and 5 are similar to FIGS. 2 and 3, but of a vane aerofoil 41 in accordance with the present invention which is based on a modification of the Controlled Flow principle. FIG. 8 is a perspective view on the trailing edge of the aerofoil 41, the aerofoil being overlaid by a computer-generated grid, as in FIG. 1. Coordinates for the computer generated grid are indicated as X, Y and Z, X being the axial direction and Z being the radial direction. As in FIG. 1, the trailing edge 43 is radially oriented and straight and the pressure face 47 of the aerofoil is convex between platform 45 and tip 46 in a plane 48 which extends both radially of the turbine and transversely of axial centre line 2, this being achieved by rotational displacement of the aerofoil sections 49 about the radial trailing edge. However, it can be seen in FIGS. 4 and 5 that the leading edge 44 at mid-height position is not forward of the platform and tip regions but is substantially in line with them, with respect to the axial direction defined by axis 2. Since the trailing edge 43 straight, the axial width W of the vane aerofoil is consequently substantially constant over substantially all of the aerofail radial height and the chord lines at mid-height aerofoil sections are shorter than the chord lines in aerofoil sections at platform or tip regions. It is found that reducing chord length at the mid-height region in this way has the effect of advantageously lowering aerodynamic profile losses without unduly affecting vane performance. This is because the "wetted" area, and hence friction loss, is reduced.

Figure 6:
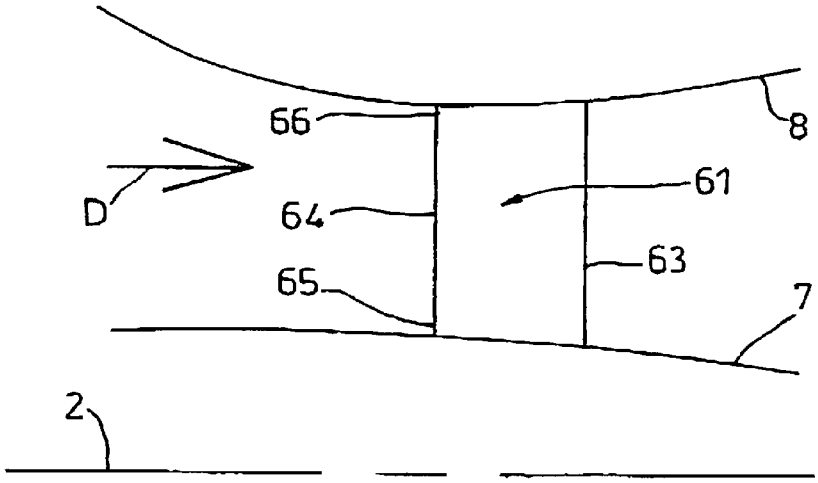
FIG. 6 is a view similar to FIG. 5, but of a different embodiment of the invention.

FIG. 6 illustrates a further embodiment of the invention applicable to first stage vane aerofoils 61 at the entry to a turbine. As in FIGS. 4, 5 and 8, the pressure face of the aerofoil is convex between platform 65 and tip 66, the leading edge 64 at mid-height position is substantially axially in line with the platform and tip regions, and the radially oriented trailing edge 63 is straight. However, it has been found advantageous to position the aerofoil 61 in relation to the axial length of the turbine such that its trailing edge 63 is in a divergent part of the gas flow passage, so causing the trailing edge 63 to be substantially longer than the leading edge 64. Although this is normal for turbine second and subsequent stages, it is not normal for a first stage 1. Usually, as shown in FIG. 5, first stage vanes have a leading edge longer than, or substantially the same length as, the trailing edge.

Figure 9:
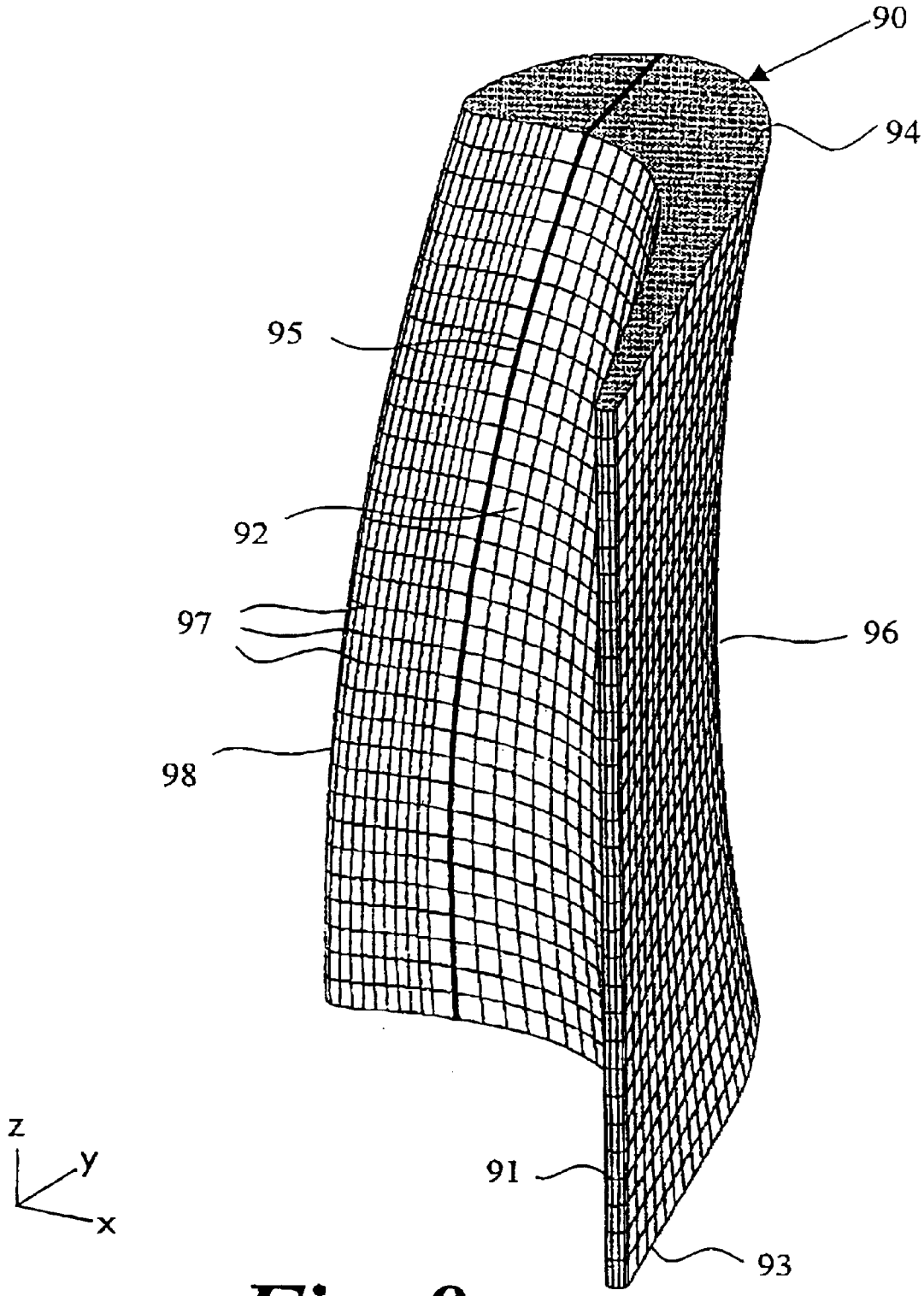
FIG. 9 is a computer generated perspective view of an aerofoil of a gas turbine engine rotor blade shaped in accordance with the present invention.

Clearly, stacking the vane aerofoil sections as described with reference to FIGS. 4 to 6 and 8, so that they have smaller outlet angles at the platform and tip regions than at mid-height, may create flow incidence problems onto the succeeding rotor blade row, and it is therefore necessary to apply similar Controlled Flow principles to the rotor blade aerofoils Hence, FIG. 9 is a perspective view similar to FIG. 8, but of a high pressure turbine rotor blade aerofoil 90 situated axially adjacent to and immediately downstream of the vane aerofoil of FIG. 8, i.e., together with vane aerofoil 41, blade aerofoil 90 comprises the first stage of a gas turbine. Similarly to the vane aerofoil 41, blade aerofoil 90 has a straight trailing edge 91 oriented in the radial direction. Referred again to a plane 95 which extends radially of the turbine and transversely of the rotational axis of the turbine, the pressure surface 92 is convex between platform region 93 and tip region 94 and the suction surface 96 is concave. As before, the spanwise convex and concave shapes of the pressure and suction surfaces respectively are achieved by rotational displacement of the aerofoil sections 97 about the trailing edge 91. Furthermore, by virtue of the radially convex and concave shapes of the pressure and suction surfaces 92 and 96, the blade aerofoil 90 as a whole is skewed towards the "throat closed" position at both the tip and platform regions, its outlet angles again being smaller at the platform and tip regions than at mid-height.

Despite these similarities, rotor blade aerofoil 90 has a somewhat different appearance from nozzle guide vane aerofoil 41 and in particular the leading edge 98 of blade aerofoil 90 has a different appearance from the leading edge 44 of vane aerofoil 41. Unlike the vane aerofoil 41, the blade aerofoil 90 tapers from platform to tip, i.e., its axial width, and hence its chord length, reduces over the aerofoil's radial height from a maximum at the platform region 93 to a minimum at the tip region 94. Such tapering of the blade aerofoil in the radial direction is intended to reduce the centrifugally induced stresses experienced in the platform region and in the root fixings of the blade during operation of the gas turbine, because the mass of the radially outer portion of the blade aerofoil is reduced. Since the aerofoil has a radially oriented straight trailing edge 91, its reduction in axial width with radial distance from the platform region means that its leading edge 98 has a backward lean in the axial direction, and this is shown in FIG. 9.

Note that if necessary for the reduction of eccentric bending stresses generated during rotation of the blade, the radially convex and concave pressure and suction surfaces respectively of the blade aerofoil can alternatively be achieved by rotating the aerofoil sections about a radial line other than a radial line though the trailing edge—e.g., a line through the centroid of the notional prismatic aerofoil. This would result in a curved trailing edge.

Figure 7:
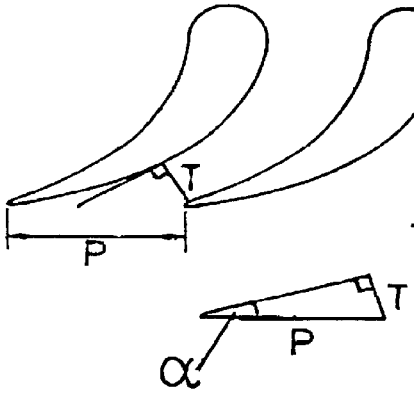
FIG. 7 is a diagram showing corresponding elemental sections of two adjacent aerofoils to illustrate the concept of outlet angle, which is important in relation to an aspect of the invention.

With regard to vane aerofoil setting angles and thus outlet angles, FIG. 7 shows corresponding elemental sections of two adjacent vane aerofoils to illustrate outlet angle $\alpha$, T being the throat dimension and P being the blade pitch. Typically, vane aerofoils are designed with setting angles (relative to axial direction) which result in larger outlet angles at the tip region than at the platform region. However, it is found advantageous in the present invention to have vane aerofoil platform and tip outlet angles of substantially the same value. Also, it is surprising that these outlet angles, being not more than about 10 degrees and preferably in the range 8–10 degrees, are less than is suggested in known gas turbines. Similarly, the outlet angle at a mid-height region for a vane aerofoil in accordance with the invention is in the range 13–16 degrees, or approximately 14 degrees, and this is less than might be expected for "Controlled Flow" designs in a gas turbine engine. This variation in outlet angle $\alpha$ over the radial height of the aerofoil is not readily apparent from the perspective of FIG. 8, but can be ready appreciated by reference to FIG. 4.

As stated, vanes and blade rows cooperate as a stage pair. Therefore, amongst other things, vane and blade aerofoil angles must be matched for best efficiency. It is found that suitable outlet angles for blade aerofoils in a turbine stage according to the invention are blade aerofoil platform and tip; $\alpha$ in the range 14–17", preferably $\alpha$=16"

blade aerofoil at mid-height; $\alpha$ in the range 18–21", preferably $\alpha$=19"

The design process for Controlled Flow vane and blade profiles considers firstly the vanes and secondly the blades, each separately, then finally together as a matching pair to achieve best overall stage performance. They are usually designed through an iterative process with inputs from physically or mathematically defined design guidelines and intuitive experience, all comprised by requirements for reasonable aerofoil strength, vibration characteristics, accommodation of internal cooling passages, etc. In the present invention the reduced chordal length at mid height is a further complication affecting the detail of profile shapes. In practice each gas turbine engine maker will generally have its own design rules and will settle for profile shapes within those rules. It is a feature of the present invention that a particularly effective set of aerofoil section profiles (from platform to tip) are achieved by adhering to X-Y co-ordinates, within certain dimensional limits of variation of X and Y, as laid down below in Tables 1 to 3 (for vane aerofoil platform region, mid-height, and tip region respectively) and Tables 4 to 6 (for blade aerofoil platform, mid-height and tip respectively). The dimensional limits of variation mentioned are plus or minus 5% of chordal length, e.g. for a chord of 30 mm the X and Y dimensions may vary by plus or minus 1.5 mm.

For scaling purposes the X-Y coordinates of Tables 1 to 6 may be multiplied by a predetermined number or scaling factor to achieve similar aerodynamic performance from either larger or smaller vanes and blades. It will be known to those skilled in the art that simple linear scaling of vanes and blades does not indicate similar linear scaling of, for example, engine power (which would, in comparison, scale to the square). Nevertheless, with appropriate scaling, the aerofoil section profile shapes and angles described in the Tables may be used for any size gas turbine engine. Further, it should be noted that the invention is not limited to the particular aerofoil section profile shapes and angles described in the Tables.

TABLE 1

| Vane Platform | | | |
|---|---|---|---|
| X (mm) | Y (mm) | X (mm) | Y (mm) |
| −5.97984E−03 | 4.69735E−01 | −2.39343E+01 | 4.64656E+01 |
| −4.35994E−03 | 3.41485E−01 | −1.97723E+01 | 4.08887E+01 |
| −4.33497E−02 | 2.19295E−01 | −2.03721E+01 | 4.16278E+01 |
| −1.18954E−01 | 1.15686E−01 | −2.09794E+01 | 4.23606E+01 |
| −2.23423E−01 | 4.12771E−02 | −2.18073E+01 | 4.33304E+01 |
| −3.46053E−01 | 3.69302E−03 | −2.26429E+01 | 4.42935E+01 |
| −4.74276E−01 | 6.78554E−03 | −2.34185E+01 | 4.53046E+01 |
| −5.94952E−01 | 5.02377E−02 | −2.39343E+01 | 4.64656E+01 |
| −6.95713E−01 | 1.29597E−01 | −2.40264E+01 | 4.77312E+01 |
| −7.66234E−01 | 2.36729E−01 | −2.36825E+01 | 4.89546E+01 |
| −9.10884E−01 | 7.57071E−01 | −2.30488E+01 | 5.00590E+01 |
| −1.15990E+00 | 1.67575E+00 | −2.22276E+01 | 5.10331E+01 |
| −1.41242E+00 | 2.59347E+00 | −2.12562E+01 | 5.18579E+01 |
| −1.66821E+00 | 3.51028E+00 | −2.01764E+01 | 5.24868E+01 |
| −1.92706E+00 | 4.42623E+00 | −1.90173E+01 | 5.28826E+01 |
| −2.18888E+00 | 5.34134E+00 | −1.77995E+01 | 5.30093E+01 |
| −2.45402E+00 | 6.25549E+00 | −1.65869E+01 | 5.28409E+01 |
| −2.72291E+00 | 7.16855E+00 | −1.54443E+01 | 5.23998E+01 |
| −2.99596E+00 | 8.08037E+00 | −1.44086E+01 | 5.17449E+01 |
| −3.27355E+00 | 8.99081E+00 | −1.34851E+01 | 5.09389E+01 |
| −3.55606E+00 | 9.89975E+00 | −1.26628E+01 | 5.00294E+01 |
| −3.84382E+00 | 1.08070E+01 | −1.19265E+01 | 4.90488E+01 |
| −4.13716E+00 | 1.17125E+01 | −1.12619E+01 | 4.80182E+01 |
| −4.43640E+00 | 1.26161E+01 | −1.06570E+01 | 4.69514E+01 |
| −4.74185E+00 | 1.35176E+01 | −1.01023E+01 | 4.58576E+01 |
| −5.05377E+00 | 1.44168E+01 | −9.59021E+00 | 4.47432E+01 |

TABLE 1-continued

| Vane Platform | | | |
|---|---|---|---|
| −5.37246E+00 | 1.53137E+01 | −9.11547E+00 | 4.36124E+01 |
| −5.69818E+00 | 1.62081E+01 | −8.67467E+00 | 4.24679E+01 |
| −6.03117E+00 | 1.70998E+01 | −8.26445E+00 | 4.13121E+01 |
| −6.37169E+00 | 1.79886E+01 | −7.88155E+00 | 4.01469E+01 |
| −6.71999E+00 | 1.88744E+01 | −7.52287E+00 | 3.89741E+01 |
| −7.07642E+00 | 1.97570E+01 | −7.18554E+00 | 3.77949E+01 |
| −7.44137E+00 | 2.06360E+01 | −6.86691E+00 | 3.66105E+01 |
| −7.81524E+00 | 2.15114E+01 | −6.56406E+00 | 3.54220E+01 |
| −8.19843E+00 | 2.23826E+01 | −6.27495E+00 | 3.42301E+01 |
| −8.59130E+00 | 2.32496E+01 | −5.99788E+00 | 3.30354E+01 |
| −8.99422E+00 | 2.41119E+01 | −5.73132E+00 | 3.18382E+01 |
| −9.40751E+00 | 2.49694E+01 | −5.47391E+00 | 3.06390E+01 |
| −9.83144E+00 | 2.58216E+01 | −5.22446E+00 | 2.94382E+01 |
| −1.02662E+01 | 2.66683E+01 | −4.98187E+00 | 2.82359E+01 |
| −1.07120E+01 | 2.75092E+01 | −4.74519E+00 | 2.70325E+01 |
| −1.11690E+01 | 2.83442E+01 | −4.51358E+00 | 2.58281E+01 |
| X−Y (mm) | X−Y (mm) | X−Y (mm) | X−Y (mm) |
| −1.16370E+01 | 2.91730E+01 | −4.28627E+00 | 2.46229E+01 |
| −1.21161E+01 | 2.99955E+01 | −4.06260E+00 | 2.34170E+01 |
| −1.26060E+01 | 3.08115E+01 | −3.84195E+00 | 2.22105E+01 |
| −1.31066E+01 | 3.16211E+01 | −3.62379E+00 | 2.10036E+01 |
| −1.36174E+01 | 3.24242E+01 | −3.40765E+00 | 1.97963E+01 |
| −1.41381E+01 | 3.32210E+01 | −3.19309E+00 | 1.85887E+01 |
| −1.46682E+01 | 3.40115E+01 | −2.97975E+00 | 1.73810E+01 |
| −1.52071E+01 | 3.47961E+01 | −2.76727E+00 | 1.61730E+01 |
| −1.57544E+01 | 3.55749E+01 | −2.55535E+00 | 1.49650E+01 |
| −1.63092E+01 | 3.63483E+01 | −2.34371E+00 | 1.37569E+01 |
| −1.68710E+01 | 3.71166E+01 | −2.13210E+00 | 1.25488E+01 |
| −1.74391E+01 | 3.78803E+01 | −1.92029E+00 | 1.13408E+01 |
| −1.80133E+01 | 3.86394E+01 | −1.70821E+00 | 1.01328E+01 |
| −1.85934E+01 | 3.93940E+01 | −1.49590E+00 | 8.92481E+00 |
| −1.91796E+01 | 4.01439E+01 | −1.28344E+00 | 7.71688E+00 |
| −1.97723E+01 | 4.08887E+01 | −1.07080E+00 | 6.50897E+00 |
| −2.03721E+01 | 4.16278E+01 | −8.58190E−01 | 5.30106E+00 |
| −2.09794E+01 | 4.23606E+01 | −6.45346E−01 | 4.09319E+00 |
| −2.18073E+01 | 4.33304E+01 | −4.31514E−01 | 2.88550E+00 |
| −2.26429E+01 | 4.42935E+01 | −2.17653E−01 | 1.67781E+00 |
| −2.34185E+01 | 4.53046E+01 | | |

TABLE 2

| Vane Mid-Height | | | |
|---|---|---|---|
| X (mm) | Y (mm) | X (mm) | Y (mm) |
| −1.17000E−02 | 4.96750E−01 | −2.09121E+01 | 3.77476E+01 |
| −1.25000E−03 | 3.68916E−01 | −2.16694E+01 | 3.86573E+01 |
| −3.17000E−02 | 2.44333E−01 | −2.24328E+01 | 3.95619E+01 |
| −1.00043E−01 | 1.35769E−01 | −2.31939E+01 | 4.04678E+01 |
| −1.99146E−01 | 5.43000E−02 | −2.38346E+01 | 4.14598E+01 |
| −3.18900E−01 | 8.42000E−03 | −2.41583E+01 | 4.25934E+01 |
| −4.47032E−01 | 2.68000E−03 | −2.41008E+01 | 4.37716E+01 |
| −5.70410E−01 | 3.77000E−02 | −2.37694E+01 | 4.49060E+01 |
| −6.76392E−01 | 1.09969E−01 | −2.32552E+01 | 4.59706E+01 |
| −7.54116E−01 | 2.11996E−01 | −2.25672E+01 | 4.69318E+01 |
| −9.20219E−01 | 6.80254E−01 | −2.17108E+01 | 4.77245E+01 |
| −1.20376E+00 | 1.49785E+00 | −2.07075E+01 | 4.82908E+01 |
| −1.49057E+00 | 2.31430E+00 | −1.95945E+01 | 4.85871E+01 |
| −1.78423E+00 | 3.12968E+00 | −1.84424E+01 | 4.85930E+01 |
| −2.07308E+00 | 3.94406E+00 | −1.73198E+01 | 4.83316E+01 |
| −2.36837E+00 | 4.75749E+00 | −1.62711E+01 | 4.78520E+01 |
| −2.66652E+00 | 5.56987E+00 | −1.53155E+01 | 4.72055E+01 |
| −2.96784E+00 | 6.38108E+00 | −1.44547E+01 | 4.64371E+01 |
| −3.27261E+00 | 7.19100E+00 | −1.36805E+01 | 4.55812E+01 |
| −3.58113E+00 | 7.99951E+00 | −1.29821E+01 | 4.46623E+01 |
| −3.89365E+00 | 8.80647E+00 | −1.23501E+01 | 4.36965E+01 |
| −4.21040E+00 | 9.61178E+00 | −1.17789E+01 | 4.26935E+01 |
| −4.53162E+00 | 1.04153E+01 | −1.12622E+01 | 4.16613E+01 |
| −4.85753E+00 | 1.12170E+01 | −1.07920E+01 | 4.06071E+01 |
| −5.18832E+00 | 1.20166E+01 | −1.03601E+01 | 3.95366E+01 |
| −5.52419E+00 | 1.28141E+01 | −9.95912E+00 | 3.84541E+01 |
| −5.86532E+00 | 1.36094E+01 | −9.58282E+00 | 3.73628E+01 |
| −6.21188E+00 | 1.44024E+01 | −9.22604E+00 | 3.62649E+01 |

TABLE 2-continued

| Vane Mid-Height | | | |
|---|---|---|---|
| X (mm) | Y (mm) | X (mm) | Y (mm) |
| −6.56403E+00 | 1.51928E+01 | −8.88461E+00 | 3.51622E+01 |
| −6.92194E+00 | 1.59807E+01 | −8.55522E+00 | 3.40558E+01 |
| −7.28575E+00 | 1.67659E+01 | −8.23523E+00 | 3.29467E+01 |
| −7.65566E+00 | 1.75482E+01 | −7.92254E+00 | 3.18355E+01 |
| −8.03195E+00 | 1.83275E+01 | −7.61556E+00 | 3.07227E+01 |
| −8.41489E+00 | 1.91035E+01 | −7.31343E+00 | 2.96085E+01 |
| −8.80478E+00 | 1.98761E+01 | −7.01553E+00 | 2.84932E+01 |
| −9.20187E+00 | 2.06449E+01 | −6.72132E+00 | 2.73770E+01 |
| −9.60644E+00 | 2.14099E+01 | −6.43029E+00 | 2.62599E+01 |
| −1.00187E+01 | 2.21708E+01 | −6.14200E+00 | 2.51421E+01 |
| −1.04389E+01 | 2.29273E+01 | −5.85607E+00 | 2.40237E+01 |
| −1.08672E+01 | 2.36792E+01 | −5.57214E+00 | 2.29048E+01 |
| −1.13037E+01 | 2.44264E+01 | −5.28989E+00 | 2.17854E+01 |
| −1.17484E+01 | 2.51688E+01 | −5.00904E+00 | 2.06657E+01 |
| −1.22015E+01 | 2.59060E+01 | −4.72933E+00 | 1.95457E+01 |
| −1.26628E+01 | 2.66382E+01 | −4.45054E+00 | 1.84255E+01 |
| −1.31321E+01 | 2.73652E+01 | −4.17246E+00 | 1.73051E+01 |
| −1.36094E+01 | 2.80871E+01 | −3.89491E+00 | 1.61846E+01 |
| −1.40943E+01 | 2.88038E+01 | −3.61773E+00 | 1.50640E+01 |
| −1.45866E+01 | 2.95155E+01 | −3.34075E+00 | 1.39433E+01 |
| −1.50858E+01 | 3.02224E+01 | −3.06385E+00 | 1.28227E+01 |
| −1.55914E+01 | 3.09246E+01 | −2.78689E+00 | 1.17020E+01 |
| −1.61030E+01 | 3.16226E+01 | −2.50979E+00 | 1.05814E+01 |
| −1.66200E+01 | 3.23166E+01 | −2.23254E+00 | 9.46078E+00 |
| −1.71420E+01 | 3.30068E+01 | −1.95519E+00 | 8.34022E+00 |
| −1.76686E+01 | 3.36935E+01 | −1.67775E+00 | 7.21967E+00 |
| −1.81996E+01 | 3.43768E+01 | −1.40023E+00 | 6.09914E+00 |
| −1.87346E+01 | 3.50569E+01 | −1.12275E+00 | 4.97861E+00 |
| −1.92736E+01 | 3.57340E+01 | −8.45036E−01 | 3.85813E+00 |
| −1.98162E+01 | 3.64080E+01 | −5.66777E−01 | 2.73779E+00 |
| −2.03624E+01 | 3.70792E+01 | −2.88609E−01 | 1.61742E+00 |

TABLE 3

| Vane Tip | | | |
|---|---|---|---|
| X (mm) | Y (mm) | X (mm) | Y (mm) |
| −4.68250E−03 | 4.61868E−01 | −2.12356E+01 | 4.47783E+01 |
| −5.61511E−03 | 3.33611E−01 | −2.18888E+01 | 4.55561E+01 |
| −4.70288E−02 | 2.12221E−01 | −2.25561E+01 | 4.63303E+01 |
| −1.24679E−01 | 1.10137E−01 | −2.32144E+01 | 4.71120E+01 |
| −2.30609E−01 | 3.78218E−02 | −2.37799E+01 | 4.79614E+01 |
| −3.53963E−01 | 2.68556E−03 | −2.41195E+01 | 4.89219E+01 |
| −4.82099E−01 | 8.32912E−03 | −2.41726E+01 | 4.99392E+01 |
| −6.01886E−01 | 5.41742E−02 | −2.39789E+01 | 5.09411E+01 |
| −7.01048E−01 | 1.35523E−01 | −2.36248E+01 | 5.18990E+01 |
| −7.69423E−01 | 2.44038E−01 | −2.31451E+01 | 5.28006E+01 |
| −9.10566E−01 | 7.95089E−01 | −2.25472E+01 | 5.36284E+01 |
| −1.15511E+00 | 1.77438E+00 | −2.15979E+01 | 5.45509E+01 |
| −1.40331E+00 | 2.75275E+00 | −2.04691E+01 | 5.52409E+01 |
| −1.65495E+00 | 3.73024E+00 | −1.92065E+01 | 5.56342E+01 |
| −1.90983E+00 | 4.70690E+00 | −1.78854E+01 | 5.56927E+01 |
| −2.16786E+00 | 5.68272E+00 | −1.65891E+01 | 5.54280E+01 |
| −2.42944E+00 | 6.65760E+00 | −1.53779E+01 | 5.48934E+01 |
| −2.69504E+00 | 7.63139E+00 | −1.42780E+01 | 5.41551E+01 |
| −2.96514E+00 | 8.60394E+00 | −1.32911E+01 | 5.32707E+01 |
| −3.24014E+00 | 9.57512E+00 | −1.24075E+01 | 5.22826E+01 |
| −3.52047E+00 | 1.05448E+01 | −1.16142E+01 | 5.12205E+01 |
| −3.80650E+00 | 1.15128E+01 | −1.08985E+01 | 5.01045E+01 |
| −4.09862E+00 | 1.24789E+01 | −1.02491E+01 | 4.89485E+01 |
| −4.39718E+00 | 1.34431E+01 | −9.65660E+00 | 4.77623E+01 |
| −4.70251E+00 | 1.44052E+01 | −9.11326E+00 | 4.65528E+01 |
| −5.01495E+00 | 1.53650E+01 | −8.61285E+00 | 4.53249E+01 |
| −5.33481E+00 | 1.63223E+01 | −8.15145E+00 | 4.40818E+01 |
| −5.66238E+00 | 1.72770E+01 | −7.72578E+00 | 4.28260E+01 |
| −5.99797E+00 | 1.82290E+01 | −7.33216E+00 | 4.15597E+01 |
| −6.34185E+00 | 1.91780E+01 | −6.96682E+00 | 4.02850E+01 |
| −6.69431E+00 | 2.01238E+01 | −6.62626E+00 | 3.90035E+01 |
| −7.05576E+00 | 2.10662E+01 | −6.30729E+00 | 3.77164E+01 |
| −7.42662E+00 | 2.20050E+01 | −6.00671E+00 | 3.64249E+01 |
| −7.80735E+00 | 2.29398E+01 | −5.72164E+00 | 3.51299E+01 |

TABLE 3-continued

| Vane Tip | | | |
|---|---|---|---|
| X (mm) | Y (mm) | X (mm) | Y (mm) |
| −8.19838E+00 | 2.38703E+01 | −5.45003E+00 | 3.38319E+01 |
| −8.60013E+00 | 2.47963E+01 | −5.19008E+00 | 3.25316E+01 |
| −9.01301E+00 | 2.57173E+01 | −4.94019E+00 | 3.12294E+01 |
| −9.43738E+00 | 2.66331E+01 | −4.69895E+00 | 2.99255E+01 |
| −9.87354E+00 | 2.75434E+01 | −4.46511E+00 | 2.86202E+01 |
| −1.03218E+01 | 2.84477E+01 | −4.23758E+00 | 2.73138E+01 |
| −1.07822E+01 | 2.93459E+01 | −4.01538E+00 | 2.60065E+01 |
| −1.12551E+01 | 3.02377E+01 | −3.79767E+00 | 2.46985E+01 |
| −1.17403E+01 | 3.11228E+01 | −3.58369E+00 | 2.33898E+01 |
| −1.22378E+01 | 3.20010E+01 | −3.37277E+00 | 2.20807E+01 |
| −1.27475E+01 | 3.28722E+01 | −3.16432E+00 | 2.07711E+01 |
| −1.32690E+01 | 3.37364E+01 | −2.95782E+00 | 1.94613E+01 |
| −1.38021E+01 | 3.45935E+01 | −2.75281E+00 | 1.81512E+01 |
| −1.43463E+01 | 3.54436E+01 | −2.54888E+00 | 1.68409E+01 |
| −1.49012E+01 | 3.62868E+01 | −2.34566E+00 | 1.55305E+01 |
| −1.54661E+01 | 3.71232E+01 | −2.14284E+00 | 1.42201E+01 |
| −1.60404E+01 | 3.79533E+01 | −1.94010E+00 | 1.29097E+01 |
| −1.66235E+01 | 3.87772E+01 | −1.73719E+00 | 1.15992E+01 |
| −1.72146E+01 | 3.95953E+01 | −1.53399E+00 | 1.02889E+01 |
| −1.78132E+01 | 4.04080E+01 | −1.33054E+00 | 8.97852E+00 |
| −1.84189E+01 | 4.12155E+01 | −1.12694E+00 | 7.66821E+00 |
| −1.90316E+01 | 4.20176E+01 | −9.23158E−01 | 6.35793E+00 |
| −1.96513E+01 | 4.28143E+01 | −7.19429E−01 | 5.04763E+00 |
| −2.02788E+01 | 4.36049E+01 | −5.15187E−01 | 3.73742E+00 |
| −2.09145E+01 | 4.43890E+01 | −3.10012E−01 | 2.42735E+00 |

TABLE 4

| Blade platform | | | |
|---|---|---|---|
| X–Y (mm) | X–Y (mm) | X–Y (mm) | X–Y (mm) |
| 1.28295E+01 | −2.06567E+01 | −5.47895E+00 | −1.25458E+00 |
| 1.28472E+01 | −2.07835E+01 | −6.22214E+00 | −1.38526E+00 |
| 1.28238E+01 | −2.09093E+01 | −7.12124E+00 | −1.60851E+00 |
| 1.27618E+01 | −2.10213E+01 | −8.00453E+00 | −1.88689E+00 |
| 1.26675E+01 | −2.11080E+01 | −8.88112E+00 | −2.18359E+00 |
| 1.25506E+01 | −2.11605E+01 | −9.77936E+00 | −2.37509E+00 |
| 1.24230E+01 | −2.11734E+01 | −1.04283E+01 | −1.82815E+00 |
| 1.22978E+01 | −2.11453E+01 | −1.05255E+01 | −9.14849E−01 |
| 1.21879E+01 | −2.10791E+01 | −1.04622E+01 | 8.34471E−03 |
| 1.21044E+01 | −2.09815E+01 | −1.03081E+01 | 9.21463E−01 |
| 1.19650E+01 | −2.06548E+01 | −1.00877E+01 | 1.82088E+00 |
| 1.17433E+01 | −2.01168E+01 | −9.80728E+00 | 2.72388E+00 |
| 1.15198E+01 | −1.95794E+01 | −9.47649E+00 | 3.60966E+00 |
| 1.12944E+01 | −1.90428E+01 | −9.09341E+00 | 4.47419E+00 |
| 1.10670E+01 | −1.85071E+01 | −8.65471E+00 | 5.31188E+00 |
| 1.08374E+01 | −1.79724E+01 | −8.15726E+00 | 6.11594E+00 |
| 1.06057E+01 | −1.74385E+01 | −7.59696E+00 | 6.87723E+00 |
| 1.03719E+01 | −1.69055E+01 | −6.96847E+00 | 7.58293E+00 |
| 1.01360E+01 | −1.63735E+01 | −6.27170E+00 | 8.22133E+00 |
| 9.89802E+00 | −1.58425E+01 | −5.50357E+00 | 8.71210E+00 |
| 9.65799E+00 | −1.53123E+01 | −4.658442+00 | 9.19564E+00 |
| 9.41597E+00 | −1.47831E+01 | −3.74869E+00 | 9.45280E+00 |
| 9.17205E+00 | −1.42547E+01 | −2.80668E+00 | 9.53246E+00 |
| 8.92637E+00 | −1.37271E+01 | −1.86616E+00 | 9.43615E+00 |
| 8.67902E+00 | −1.32004E+01 | −9.57810E−01 | 9.17311E+00 |
| 8.42989E+00 | −1.26744E+01 | −1.04449E−01 | 8.76515E+00 |
| 8.17873E+00 | −1.21495E+01 | 6.82009E−01 | 8.23940E+00 |
| 7.92536E+00 | −1.16256E+01 | 1.39911E+00 | 7.62230E+00 |
| 7.66947E+00 | −1.11029E+01 | 2.05179E+00 | 6.93743E+00 |
| 7.41012E+00 | −1.05818E+01 | 2.64832E+00 | 6.20319E+00 |
| 7.14631E+00 | −1.00630E+01 | 3.19469E+00 | 5.43099E+00 |
| 6.87841E+00 | −9.54631E+00 | 3.70185E+00 | 4.63262E+00 |
| 6.60512E+00 | −9.03238E+00 | 4.17656E+00 | 3.81457E+00 |
| 6.32517E+00 | −8.52201E+00 | 4.62045E+00 | 2.97948E+00 |
| 6.03732E+00 | −8.01601E+00 | 5.04412E+00 | 2.13417E+00 |
| 5.74018E+00 | −7.51534E+00 | 5.45438E+00 | 1.28230E+00 |
| 5.43224E+00 | −7.02118E+00 | 5.85085E+00 | 4.23883E−01 |
| 5.11184E+00 | −6.53492E+00 | 6.23033E+00 | −4.42313E−01 |
| 4.77737E+00 | −6.05815E+00 | 6.58857E+00 | −1.31750E+00 |
| 4.42735E+00 | −5.59260E+00 | 6.93009E+00 | −2.19930E+00 |

TABLE 4-continued

| Blade platform | | | |
|---|---|---|---|
| X–Y (mm) | X–Y (mm) | X–Y (mm) | X–Y (mm) |
| 4.06056E+00 | −5.14004E+00 | 7.25292E+00 | −3.08818E+00 |
| 3.67608E+00 | −4.70233E+00 | 7.55721E+00 | −3.98345E+00 |
| 3.27333E+00 | −4.28129E+00 | 7.85302E+00 | −4.88132E+00 |
| 2.85197E+00 | −3.87880E+00 | 8.14599E+00 | −5.78005E+00 |
| 2.41183E+00 | −3.49683E+00 | 8.43694E+00 | −6.67945E+00 |
| 1.95299E+00 | −3.13744E+00 | 8.72549E+00 | −7.57962E+00 |
| 1.47579E+00 | −2.80273E+00 | 9.01172E+00 | −8.48052E+00 |
| 9.80845E−01 | −2.49476E+00 | 9.29643E+00 | −9.38188E+00 |
| 4.69126E−01 | −2.21549E+00 | 9.58041E+00 | −1.02834E+01 |
| −5.80740E−02 | −1.96662E+00 | 9.86412E+00 | −1.11851E+01 |
| −5.99163E−01 | −1.74958E+00 | 1.01477E+01 | −1.20868E+01 |
| −1.15230E+00 | −1.56544E+00 | 1.04311E+01 | −1.29885E+01 |
| −1.71549E+00 | −1.41487E+00 | 1.07144E+01 | −1.38903E+01 |
| −2.28662E+00 | −1.29816E+00 | 1.09976E+01 | −1.47921E+01 |
| −2.86357E+00 | −1.21517E+00 | 1.12807E+01 | −1.56940E+01 |
| −3.44433E+00 | −1.16577E+00 | 1.15636E+01 | −1.65959E+01 |
| −4.02692E+00 | −1.15005E+00 | 1.18463E+01 | −1.74978E+01 |
| −4.60941E+00 | −1.16766E+00 | 1.21295E+01 | −1.83996E+01 |
| −5.18994E+00 | −1.21772E+00 | 1.24122E+01 | −1.93016E+01 |

TABLE 5

| Blade Mid-Height | | | |
|---|---|---|---|
| X (mm) | Y (mm) | X (mm) | Y (mm) |
| 1.23893E+01 | −1.90680E+01 | −5.26410E+00 | −9.42599E−01 |
| 1.24106E+01 | −1.91945E+01 | −6.07693E+00 | −9.99129E−01 |
| 1.23908E+01 | −1.93213E+01 | −6.88482E+00 | −1.10519E+00 |
| 1.23320E+01 | −1.94353E+01 | −7.69007E+00 | −1.23009E+00 |
| 1.22401E+01 | −1.95249E+01 | −8.50128E+00 | −1.19699E+00 |
| 1.21246E+01 | −1.95809E+01 | −9.15014E+00 | −7.30371E−01 |
| 1.19974E+01 | −1.95975E+01 | −9.39980E+00 | 4.05600E−02 |
| 1.18714E+01 | −1.95731E+01 | −9.41515E+00 | 8.54467E−01 |
| 1.17597E+01 | −1.95101E+01 | −9.31880E+00 | 1.66339E+00 |
| 1.16735E+01 | −1.94150E+01 | −9.14888E+00 | 2.46020E+00 |
| 1.15336E+01 | −1.91105E+01 | −8.91008E+00 | 3.25372E+00 |
| 1.13138E+01 | −1.86153E+01 | −8.60472E+00 | 4.03865E+00 |
| 1.10923E+01 | −1.81208E+01 | −8.23789E+00 | 4.79679E+00 |
| 1.08689E+01 | −1.76272E+01 | −7.80816E+00 | 5.52110E+00 |
| 1.06435E+01 | −1.71345E+01 | −7.31397E+00 | 6.20301E+00 |
| 1.04161E+01 | −1.66427E+01 | −6.75336E+00 | 6.83138E+00 |
| 1.01867E+01 | −1.61519E+01 | −6.12475E+00 | 7.39157E+00 |
| 9.95554E+00 | −1.56618E+01 | −5.42703E+00 | 7.86261E+00 |
| 9.72272E+00 | −1.51726E+01 | −4.66495E+00 | 8.21995E+00 |
| 9.48835E+00 | −1.46841E+01 | −3.85360E+00 | 8.44356E+00 |
| 9.25257E+00 | −1.41963E+01 | −3.01568E+00 | 8.52181E+00 |
| 9.13417E+00 | −1.39526E+01 | −2.59484E+00 | 8.50446E+00 |
| 9.01546E+00 | −1.37091E+01 | −2.17720E+00 | 8.44981E+00 |
| 8.77711E+00 | −1.32225E+01 | −1.36345E+00 | 8.23479E+00 |
| 8.53764E+00 | −1.27365E+01 | −5.93556E−01 | 7.89434E+00 |
| 8.29716E+00 | −1.22510E+01 | 1.21631E−01 | 7.45004E+00 |
| 8.05554E+00 | −1.17660E+01 | 7.79230E−01 | 6.92404E+00 |
| 7.81263E+00 | −1.12817E+01 | 1.38073E+00 | 6.33459E+00 |
| 7.56831E+00 | −1.07981E+01 | 1.93083E+00 | 5.69680E+00 |
| 7.32222E+00 | −1.03154E+01 | 2.43677E+00 | 5.02337E+00 |
| 7.07308E+00 | −9.83425E+00 | 2.90625E+00 | 4.32400E+00 |
| 6.82103E+00 | −9.35463E+00 | 3.34479E+00 | 3.60480E+00 |
| 6.56549E+00 | −8.87686E+00 | 3.75675E+00 | 2.87004E+00 |
| 6.30517E+00 | −8.40168E+00 | 4.14585E+00 | 2.12291E+00 |
| 6.03889E+00 | −7.92982E+00 | 4.51422E+00 | 1.36535E+00 |
| 5.76538E+00 | −7.46211E+00 | 4.86527E+00 | 5.99590E−01 |
| 5.48326E+00 | −6.99954E+00 | 5.20428E+00 | −1.71578E−01 |
| 5.19097E+00 | −6.54334E+00 | 5.53316E+00 | −9.47124E−01 |
| 4.88691E+00 | −6.09490E+00 | 5.85259E+00 | −1.72660E+00 |
| 4.56958E+00 | −5.65576E+00 | 6.16253E+00 | −2.50991E+00 |
| 4.23770E+00 | −5.22751E+00 | 6.46670E+00 | −3.29547E+00 |
| 3.89030E+00 | −4.81176E+00 | 6.76906E+00 | −4.08174E+00 |
| 3.52670E+00 | −4.41010E+00 | 7.07041E+00 | −4.86839E+00 |
| 3.14651E+00 | −4.02412E+00 | 7.37070E+00 | −5.65545E+00 |
| 2.74903E+00 | −3.65597E+00 | 7.66968E+00 | −6.44301E+00 |
| 2.33376E+00 | −3.30802E+00 | 7.96748E+00 | −7.23101E+00 |

TABLE 5-continued

| Blade Mid-Height | | | |
|---|---|---|---|
| X (mm) | Y (mm) | X (mm) | Y (mm) |
| 1.90124E+00 | −2.98177E+00 | 8.26446E+00 | −8.01933E+00 |
| 1.45242E+00 | −2.67833E+00 | 8.56098E+00 | −8.80781E+00 |
| 9.88481E−01 | −2.39855E+00 | 8.85727E+00 | −9.59638E+00 |
| 5.10721E−01 | −2.14309E+00 | 9.15340E+00 | −1.03850E+01 |
| 2.05279E−02 | −1.91238E+00 | 9.44937E+00 | −1.11737E+01 |
| −4.80663E−01 | −1.70665E+00 | 9.74521E+00 | −1.19625E+01 |
| −9.91404E−01 | −1.52591E+00 | 1.00409E+01 | −1.27513E+01 |
| −1.51026E+00 | −1.37000E+00 | 1.03365E+01 | −1.35401E+01 |
| −2.03585E+00 | −1.23854E+00 | 1.06319E+01 | −1.43290E+01 |
| −2.56686E+00 | −1.13105E+00 | 1.09270E+01 | −1.51180E+01 |
| −3.10212E+00 | −1.04721E+00 | 1.12218E+01 | −1.59072E+01 |
| −3.64051E+00 | −9.86699E−01 | 1.15158E+01 | −1.66966E+01 |
| −4.18100E+00 | −9.49149E−01 | 1.18090E+01 | −1.74863E+01 |
| −4.72258E+00 | −9.34303E−01 | 1.21004E+01 | −1.82767E+01 |

TABLE 6

| Blade Tin | | | |
|---|---|---|---|
| X (mm) | Y (mm) | X (mm) | Y (mm) |
| 1.07073E+01 | −2.13251E+01 | −4.72853E+00 | 1.30247E+00 |
| 1.07213E+01 | −2.14512E+01 | −5.57007E+00 | 1.23777E+00 |
| 1.06952E+01 | −2.15754E+01 | −6.40589E+00 | 1.12234E+00 |
| 1.06316E+01 | −2.16852E+01 | −7.24159E+00 | 1.00621E+00 |
| 1.05369E+01 | −2.17697E+01 | −8.08318E+00 | 1.00430E+00 |
| 1.04205E+01 | −2.18203E+01 | −8.77869E+00 | 1.43708E+00 |
| 1.02941E+01 | −2.18320E+01 | −9.01179E+00 | 2.24118E+00 |
| 1.01704E+01 | −2.18037E+01 | −9.01241E+00 | 3.08439E+00 |
| 1.00618E+01 | −2.17381E+01 | −8.91320E+00 | 3.92206E+00 |
| 9.97906E+00 | −2.16418E+01 | −8.73634E+00 | 4.74696E+00 |
| 9.83998E+00 | −2.13174E+01 | −8.47843E+00 | 5.55610E+00 |
| 9.62101E+00 | −2.07816E+01 | −8.13325E+00 | 6.33782E+00 |
| 9.40378E+00 | −2.02451E+01 | −7.69912E+00 | 7.07379E+00 |
| 9.18810E+00 | −1.97079E+01 | −7.17450E+00 | 7.74815E+00 |
| 8.97380E+00 | −1.91702E+01 | −6.56032E+00 | 8.34195E+00 |
| 8.76071E+00 | −1.86320E+01 | −5.86147E+00 | 8.83306E+00 |
| 8.65456E+00 | −1.83627E+01 | −5.48341E+00 | 9.03249E+00 |
| 8.54864E+00 | −1.80934E+01 | −5.08888E+00 | 9.19697E+00 |
| 8.33742E+00 | −1.75545E+01 | −4.26187E+00 | 9.40933E+00 |
| 8.12689E+00 | −1.70153E+01 | −3.40916E+00 | 9.45098E+00 |
| 7.91686E+00 | −1.64759E+01 | −2.56663E+00 | 9.31340E+00 |
| 7.70718E+00 | −1.59363E+01 | −1.76839E+00 | 9.01007E+00 |
| 7.49767E+00 | −1.53967E+01 | −1.03332E+00 | 8.57487E+00 |
| 7.28817E+00 | −1.48571E+01 | −3.64637E−01 | 8.04290E+00 |
| 7.07851E+00 | −1.43176E+01 | 2.42384E−01 | 7.44131E+00 |
| 6.86851E+00 | −1.37782E+01 | 7.94942E−01 | 6.78923E+00 |
| 6.65803E+00 | −1.32389E+01 | 1.30016E+00 | 6.09976E+00 |
| 6.44687E+00 | −1.27000E+01 | 1.76421E+00 | 5.38190E+00 |
| 6.23489E+00 | −1.21613E+01 | 2.19209E+00 | 4.64188E+00 |
| 6.02190E+00 | −1.16231E+01 | 2.58694E+00 | 3.88372E+00 |
| 5.80774E+00 | −1.10853E+01 | 2.95158E+00 | 3.11056E+00 |
| 5.59223E+00 | −1.05481E+01 | 3.28912E+00 | 2.32518E+00 |
| 5.37508E+00 | −1.00115E+01 | 3.60270E+00 | 1.52992E+00 |
| 5.15593E+00 | −9.47576E+00 | 3.89670E+00 | 7.27210E−01 |
| 4.93438E+00 | −8.94099E+00 | 4.17559E+00 | −8.08786E−02 |
| 4.70999E+00 | −8.40741E+00 | 4.44376E+00 | −8.92592E−01 |
| 4.48227E+00 | −7.87524E+00 | 4.70528E+00 | −1.70648E+00 |
| 4.25066E+00 | −7.34475E+00 | 4.96277E+00 | −2.52164E+00 |
| 4.01453E+00 | −6.81625E+00 | 5.21777E+00 | −3.33760E+00 |
| 3.77316E+00 | −6.29014E+00 | 5.47144E+00 | −4.15396E+00 |
| 3.52572E+00 | −5.76684E+00 | 5.72460E+00 | −4.97048E+00 |
| 3.27126E+00 | −5.24693E+00 | 5.97770E+00 | −5.78703E+00 |
| 3.00866E+00 | −4.73108E+00 | 6.23078E+00 | −6.60358E+00 |
| 2.73667E+00 | −4.22012E+00 | 6.48420E+00 | −7.42002E+00 |
| 2.45379E+00 | −3.71512E+00 | 6.73800E+00 | −8.23634E+00 |
| 2.15834E+00 | −3.21736E+00 | 6.99169E+00 | −9.05270E+00 |
| 1.84841E+00 | −2.72850E+00 | 7.24527E+00 | −9.86910E+00 |
| 1.52188E+00 | −2.25057E+00 | 7.49865E+00 | −1.06856E+01 |
| 1.17652E+00 | −1.78609E+00 | 7.75180E+00 | −1.15021E+01 |
| 8.10075E−01 | −1.33805E+00 | 8.00470E+00 | −1.23187E+01 |
| 4.20536E−01 | −9.09968E−01 | 8.25732E+00 | −1.31354E+01 |

TABLE 6-continued

| Blade Tin | | | |
|---|---|---|---|
| X (mm) | Y (mm) | X (mm) | Y (mm) |
| 6.40944E−03 | −5.05638E−01 | 8.50961E+00 | −1.39522E+01 |
| −4.33245E−01 | −1.29250E−01 | 8.76149E+00 | −1.47691E+01 |
| −8.99114E−01 | 2.14126E−01 | 9.01281E+00 | −1.55862E+01 |
| −1.39108E+00 | 5.18903E−01 | 9.26335E+00 | −1.64035E+01 |
| −1.90784E+00 | 7.79380E−01 | 9.51275E+00 | −1.72212E+01 |
| −2.44668E+00 | 9.90366E−01 | 9.76037E+00 | −1.80394E+01 |
| −3.00347E+00 | 1.14798E+00 | 1.00051E+01 | −1.88585E+01 |
| −3.57307E+00 | 1.25054E+00 | 1.02452E+01 | −1.96790E+01 |
| −4.14974E+00 | 1.30017E+00 | 1.04787E+01 | −2.05013E+01 |

What is claimed is:

1. A turbine stator vane for use in a ring of similar vanes arranged in an axial flow turbine having an annular path for a turbine working fluid, the vane comprising: an aerofoil spanning the annular path and having a radially inner platform region, a radially outer tip region, an axially forward leading edge and an axially rearward trailing edge, the aerofoil having a pressure surface and a suction surface which are respectively convex and concave between the platform region and the tip region in a plane extending both radially of the annular path and transversely of an axial direction, the trailing edge of the aerofoil being straight from the platform region to the tip region and oriented radially of the annular path, and said convex and concave curvatures of the aerofoil pressure and suction surfaces being achieved by rotational displacement of aerofoil sections about the straight trailing edge, the aerofoil having an axial width which is substantially constant over substantially all of a radial height of the aerofoil, and a chord line at mid-height of the aerofoil sections being shorter than chord lines in the aerofoil sections at the platform and tip regions.

2. The turbine stator vane according to claim 1, comprising a nozzle guide vane aerofoil.

3. The turbine stator vane according to claim 1, the aerofoil having platform and tip outlet angles of substantially the same value.

4. The turbine stator vane according to claim 1, the aerofoil having outlet angles at the platform and tip regions being not more than about 10°.

5. The turbine stator vane according to claim 4, the aerofoil outlet angles at the platform and tip regions being in a range from 8° to 10°.

6. The turbine stator vane according to claim 1, the aerofoil having an outlet angle at mid-height of the aerofoil being in a range from 13° to about 160°.

7. The turbine stator vane according to claim 6, the aerofoil outlet angle at the mid-height of the aerofoil being approximately 14°.

8. The turbine stator vane according to claim 1, the aerofoil being of approximately constant aerofoil cross-section from the platform region to the tip region.

9. The turbine stator vane according to claim 2, including nozzle guide vane aerofoils that are positioned in relation to an axial length of the turbine such that trailing edges of the aerofoils are in a divergent part of a gas flow passage, the trailing edges of the aerofoils being substantially longer than leading edges of the aerofoils.

10. A turbine stage, comprising: a row of stator vanes, each stator vane including a vane aerofoil spanning an annular path for a turbine working fluid and having a radially inner platform region, a radially outer tip region, an axially forward leading edge and an axially rearward trailing edge, the vane aerofoil having a pressure surface and a suction surface which are respectively convex and concave between the platform region and the tip region in a plane extending both radially of the annular path and transversely of an axial direction, the trailing edge of the vane aerofoil being straight from the platform region to the tip region and oriented radially of the annular path, and said convex and concave curvatures of the aerofoil pressure and suction surfaces being achieved by rotational displacement of vane aerofoil sections about the straight trailing edge, the vane aerofoil having an axial width which is substantially constant over substantially all of a radial height of the vane aerofoil, and a chord line at mid-height of the vane aerofoil sections being shorter than chord lines in the vane aerofoil sections at the platform and tip regions; and a row of rotor blades in flow sequence with the vanes, the blades comprising blade aerofoils each having a radially inner platform region, a radially outer tip region, an axially forward leading edge and an axially rearward trailing edge, each blade aerofoil having a pressure surface and a suction surface which are respectively convex and concave between the platform region and the tip region in a plane extending both radially of the annular path and transversely of the axial direction, said convex and concave curvatures of the blade aerofoil pressure and suction surfaces being achieved by rotational displacement of blade aerofoil sections about a radial line through the blade aerofoil, each blade aerofoil having outlet angles which are smaller near its platform and tip regions than at mid-height.

11. The turbine stage according to claim 10, each blade aerofoil having a radially oriented straight trailing edge, and the rotational displacement of the blade aerofoil sections being about the straight trailing edge.

12. The turbine stage according to claim 10, in which each blade aerofoil tapers from its platform region to its tip region, such that its chord length reduces over the blade aerofoil's radial height from a maximum at its platform region to a minimum at its tip region and its leading edge has a backward lean in the axial direction.

13. The turbine stage according to claim 10, in which the blade aerofoil has platform and tip outlet angles that are in a range from 14° to 17°.

14. The turbine stage according to claim 13, in which the blade aerofoil platform and tip outlet angles are about 16°.

15. The turbine stage according to claim 10, in which the blade aerofoil has an outlet angle at mid-height of the blade aerofoil that is in a range from 18° to 21°.

16. The turbine stage according to claim 15, in which the blade aerofoil outlet angle at the mid-height of the aerofoil is about 19°.

17. A stator vane for a gas turbine engine whose aerofoil section profiles in X-Y coordinates at the platform region, mid-height region, and tip region are substantially as shown in Tables 1–3, respectively, within dimensional limits of variation of X and Y of ±5% of chordal length.

18. A rotor blade for a gas turbine engine whose aerofoil section profiles in X-Y coordinates at the platform region, mid-height region, and tip region are substantially as shown in Tables 4–6, respectively, within dimensional limits of variation of X and Y of ±5% of chordal length.

19. A turbine stage, comprising: a row of stator vanes, each stator vane including a vane aerofoil spanning an annular path for a turbine working fluid and having a radially inner platform region, a radially outer tip region, an axially forward leading edge and an axially rearward trailing edge, the vane aerofoil having a pressure surface and a suction surface which are respectively convex and concave between the platform region and the tip region in a plane extending both radially of the annular path and transversely of an axial direction, the trailing edge of the vane aerofoil being straight from the platform region to the tip region and oriented radially of the annular path, and said convex and concave curvatures of the aerofoil pressure and suction surfaces being achieved by rotational displacement of vane aerofoil sections about the straight trailing edge, the vane aerofoil having an axial width which is substantially constant over substantially all of a radial height of the vane aerofoil, and a chord line at mid-height of the vane aerofoil sections being shorter than chord lines in the aerofoil sections at the platform and tip regions; and a row of blades in flow sequence with the vanes, the blades comprising blade aerofoils each having a radially inner platform region, a radially outer tip region, an axially forward leading edge and an axially rearward trailing edge, each blade aerofoil having a pressure surface and a suction surface which are respectively convex and concave between the platform region and the tip region in a plane extending both radially of the annular path and transversely of the axial direction, said convex and concave curvatures of the blade aerofoil pressure and suction surfaces being achieved by rotational displacement of blade aerofoil sections about a radial line through the blade aerofoil, each blade aerofoil having outlet angles which are smaller near its platform and tip regions than at mid-height, whose blade aerofoil section profiles in X-Y coordinates at the platform region, mid-height region, and tip region are substantially as shown in Tables 4–6, respectively, within dimensional limits of variation of X and Y of ±5% of chordal length.

20. A turbine stage, comprising: a row of stator vanes, each stator vane including a vane aerofoil spanning an annular path for a turbine working fluid and having a radially inner platform region, a radially outer tip region, an axially forward leading edge and an axially rearward trailing edge, the vane aerofoil having a pressure surface and a suction surface which are respectively convex and concave between the platform region and the tip region in a plane extending both radially of the annular path and transversely of an axial direction, the trailing edge of the vane aerofoil being straight from the platform region to the tip region and oriented radially of the annular path, and said convex and concave curvatures of the aerofoil pressure and suction surfaces being achieved by rotational displacement of vane aerofoil sections about the straight trailing edge, the vane aerofoil having an axial width which is substantially constant over substantially all of a radial height of the vane aerofoil, and a chord line at mid-height of the vane aerofoil sections being shorter than chord lines in the vane aerofoil sections at the platform and tip region, whose vane aerofoil section profiles in X-Y coordinates at the platform region, mid-height region, and tip region are substantially as shown in Tables 1–3, respectively, within dimensional limits of variation of X and Y of ±5% of chordal length; and a row of blades in flow sequence with the vanes, whose blade aerofoil section profiles in X-Y coordinates at the platform region, mid-height region, and tip region are substantially as shown in Tables 4–6, respectively, within dimensional limits of variation of X and Y of ±5% of chordal length.

* * * * *